US007638933B2

(12) United States Patent
Jiang et al.

(10) Patent No.: US 7,638,933 B2
(45) Date of Patent: Dec. 29, 2009

(54) ELECTRON EMISSION DEVICE COMPRISING CARBON NANOTUBES YARN AND METHOD FOR GENERATING EMISSION CURRENT

(75) Inventors: Kai-Li Jiang, Beijing (CN); Peng Liu, Beijing (CN); Yang Wei, Beijing (CN); Liang Liu, Beijing (CN); Shou-Shan Fan, Beijing (CN)

(73) Assignees: Beijing FUNATE Innovation Technology Co., Ltd., Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 428 days.

(21) Appl. No.: 11/478,406

(22) Filed: Jun. 28, 2006

(65) Prior Publication Data

US 2009/0289555 A1 Nov. 26, 2009

(30) Foreign Application Priority Data

Oct. 14, 2005 (CN) ..... 2005 1 0100365

(51) Int. Cl.
*H01J 13/08* (2006.01)
*H01J 19/06* (2006.01)
*H01J 19/30* (2006.01)
*H01K 1/04* (2006.01)

(52) U.S. Cl. ..... 313/355; 313/310; 313/346 R; 315/32; 315/49; 315/163; 315/169.1

(58) Field of Classification Search ..... 313/306, 313/309–310, 346, 351, 355, 495–497; 315/32, 315/49–51, 56, 94, 160–163, 175, 169.1, 315/169.4
See application file for complete search history.

(56) References Cited

U.S. PATENT DOCUMENTS

| | | | | |
|---|---|---|---|---|
| 4,333,035 | A * | 6/1982 | Parker et al. | 313/411 |
| 5,841,219 | A * | 11/1998 | Sadwick et al. | 313/293 |
| 6,091,187 | A * | 7/2000 | Golladay et al. | 313/310 |
| 7,397,175 | B2 * | 7/2008 | Hwu et al. | 313/293 |
| 7,553,446 | B1 * | 6/2009 | Treece et al. | 422/22 |
| 2004/0053780 | A1 | 3/2004 | Jiang et al. | |

(Continued)

FOREIGN PATENT DOCUMENTS

WO WO 2006073460 A2 * 7/2006

OTHER PUBLICATIONS

Jiang et al., "Spinning Continuous Carbon Nanotube Yarns", Oct. 2002, Nature, vol. 419, p. 801.*

(Continued)

*Primary Examiner*—Sikha Roy
*Assistant Examiner*—Jose M Diaz
(74) *Attorney, Agent, or Firm*—D. Austin Bonderer

(57) ABSTRACT

An exemplary electron emission device includes an electron emitter, an anode opposite to and spaced apart from the electron emitter, a first power supply circuit, and a second power supply circuit. The first power supply circuit is configured for electrically connecting the electron emitter and the anode with a power supply to generate an electric field between the electron emitter and the anode. The second power supply circuit is configured for electrically connecting the electron emitter with a power supply to supply a heating current for heating the electron emitter whereby electrons emit therefrom. Methods for generating an emission current with a relatively higher stability also are provided.

16 Claims, 3 Drawing Sheets

U.S. PATENT DOCUMENTS

| | | | | |
|---|---|---|---|---|
| 2006/0124958 | A1* | 6/2006 | Cox et al. | 257/109 |
| 2007/0057620 | A1* | 3/2007 | Chen | 313/496 |
| 2007/0144780 | A1* | 6/2007 | Jiang et al. | 174/94 R |
| 2008/0170982 | A1* | 7/2008 | Zhang et al. | 423/447.3 |

OTHER PUBLICATIONS

"A study on field emission patterns of sigle-walled carbon nanotubes", Zhang et al., China physics sociaty, vol. 51, p. 434-437(2002).

* cited by examiner

ELECTRON EMISSION DEVICE COMPRISING CARBON NANOTUBES YARN AND METHOD FOR GENERATING EMISSION CURRENT

TECHNICAL FIELD

This invention relates generally to electron emission areas, and more particularly to electron emission devices and methods for generating an emission current.

BACKGROUND

Carbon nanotubes are quasi-one-dimensional nanostructures and were first reported in an article by Sumio Iijima entitled "Helical Microtubules of Graphitic Carbon" (Nature, Vol. 354, Nov. 7, 1991, pp. 56-58). Carbon nanotubes have been highlighted as a new functional material expected to have many microscopic and macroscopic applications. Extensive research has been conducted into using carbon nanotubes in various applications, for example in electron emission devices, etc.

Typical electron emission devices incorporating carbon nanotubes each includes a cathode with carbon nanotubes acting as electron emitter formed thereon, and a counter anode with a phosphor layer formed thereon. Emission current can be obtained by applying a voltage difference of a few hundred volts to a thousand volts between the cathode and the counter anode which are received in a vacuum space. The strength of an emission current can be varied with the variation of the magnitude of the voltage difference.

Generally, it is impractical to adjust the strength of the emission current due to the large voltage difference applied between the cathode and counter anode. In addition, molecules accumulated at the carbon nanotubes may contaminate the carbon nanotubes which results in large fluctuation in the emission current, even causes the loss of the electron emission capability of the carbon nanotubes. Therefore in order to achieve an emission current with relatively high stability, it is necessary to operate the carbon nanotubes formed on the cathode at a much higher vacuum ranging from $1\times10^{-9}$ to $1\times10^{-8}$ millibars (1 millibar=100 pascals). However, this high vacuum maintenance will inevitably result in the increase of cost of the electron emission devices.

What is needed is to provide an electron emission device with a practically adjustable and relatively stable emission current, and method for generating such an emission current.

SUMMARY

A preferred embodiment provides an electron emission device including: an electron emitter, an anode opposite to and spaced apart from the electron emitter, a first power supply circuit, and a second power supply circuit. The first power supply circuit is configured for electrically connecting the electron emitter and the anode with a power supply to generate an electric field between the electron emitter and the anode. The second power supply circuit is configured for electrically connecting the electron emitter with a power supply to supply a heating current for heating the electron emitter whereby electrons emit therefrom.

In another preferred embodiment, a method for generating an emission current includes the steps of: providing an electron emitter; disposing an anode opposite to and spaced apart from the electron emitter; applying a first voltage between the electron emitter and the anode configured for generating an electric field therebetween; and applying a second voltage on the electron emitter configured for generating a current to heat the electron emitter whereby electrons emit therefrom, to form the emission current.

Other advantages and novel features will become more apparent from the following detailed description of embodiments when taken in conjunction with the accompanying drawings.

BRIEF DESCRIPTION OF THE DRAWINGS

Many aspects of the present electron emission device and method for generating an emission current can be better understood with reference to the following drawings. The components in the drawings are not necessarily drawn to scale, the emphasis instead being placed upon clearly illustrating the principles of the present electron emission device and method. Moreover, in the drawings, like reference numerals designate corresponding parts throughout the several views.

The exemplifications set out herein illustrate various preferred embodiments, in various forms, and such exemplifications are not to be construed as limiting the scope of the present electron emission device and method in any manner.

DETAILED DESCRIPTION OF PREFERRED EMBODIMENTS

Embodiment One

Figure 1:
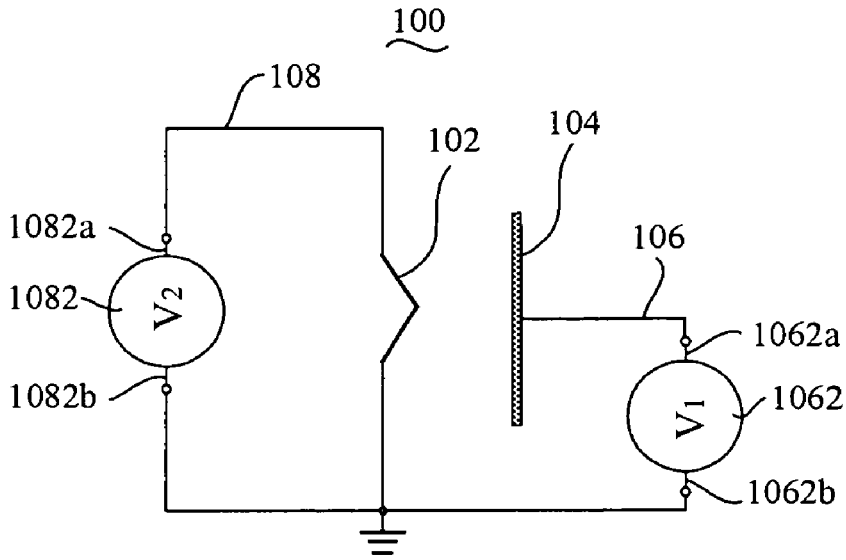
FIG. 1 is a schematic view of an electron emission device incorporating a carbon nanotube yarn acting as electron emitter, in accordance with a first embodiment.

Referring to FIG. 1, an electron emission device 100 in accordance with a first embodiment is shown. The electron emission device 100 includes an electron emitter 102, an anode 104, a first power supply circuit 106 electrically connected with the electron emitter 102 and the anode 104 and configured for generating an electric field therebetween, and a second power supply circuit 108 electrically connected with the electron emitter 102 and configured for supplying a heating current for heating the electron emitter whereby electrons emit therefrom.

Figure 2:
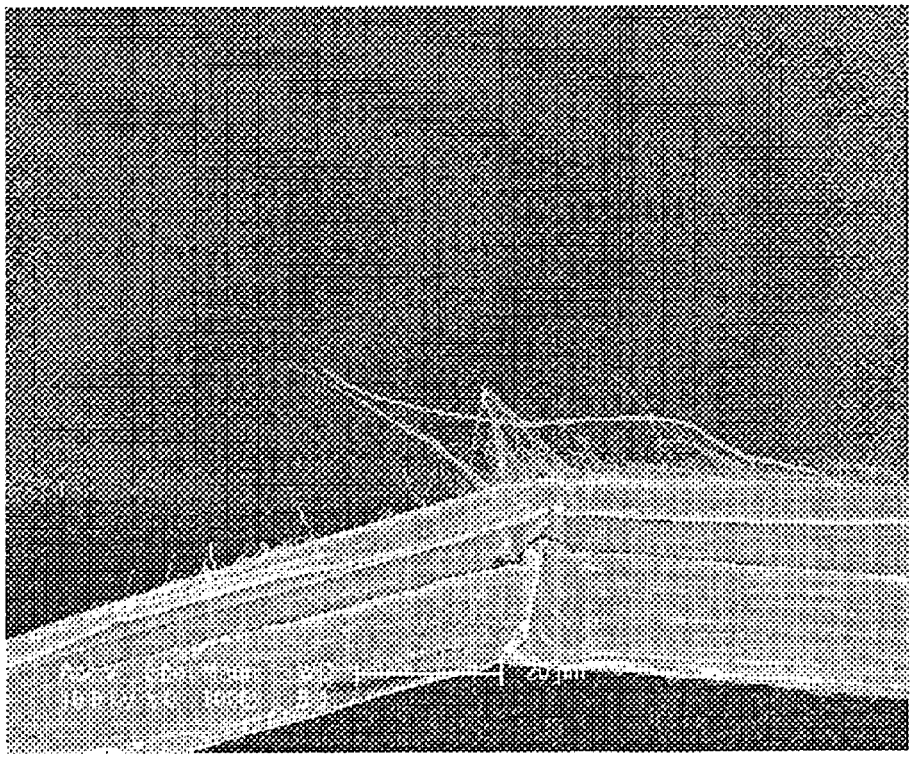
FIG. 2 is a transmission electron microscope (TEM) image of the carbon nanotube yarn of FIG. 1.

The electron emitter 102 is a carbon nanotube yarn. As shown in FIG. 2 (scale bar is 20 micrometers), the carbon nanotube yarn is usually composed of a plurality of carbon nanotubes parallel to one another and bundled together by van der waals interactions. The carbon nanotube yarn usually has a diameter of no less than 1 micrometer. In the illustrated embodiment, the carbon nanotube yarn is bended and has a diameter of about 20 micrometers and a length of about 2 centimeters. A method for fabricating the carbon nanotube yarn can include the following steps of forming a initial carbon nanotube yarn by way of pulling out a bundle of carbon nanotubes from a super-aligned carbon nanotube array, more detailed information on the formation of the initial carbon nanotube yarn is taught in U.S. Pub. No. 2004/0053780 entitled "Method for fabricating carbon nanotube yarn", which is incorporated herein by reference; dipping the initial carbon nanotube yarn into water ($H_2O$) or a volatile organic solvent including, for example ethanol ($C_2H_5OH$), acetone ($C_3H_6O$), to shrink the initial carbon nanotube yarn, thereby the mechanical strength thereof being improved and the carbon nanotube yarn being obtained.

The anode 104 is disposed opposite to and spaced apart from the electron emitter 102. Usually, a phosphor layer (not shown) is formed on a surface of the anode 104 facing toward the electron emitter 102. When electrons emitted from the electron emitter 102 strike the phosphor layer, light can be emitted from the phosphor layer.

When the electron emission device 100 is in operation, the first power supply circuit 106 is connected to terminals 1062*a* and 1062*b* of a power supply 1062 to generate an electric field between the electron emitter 102 and the anode 104. Preferably, the electric field is about 0.6 volts per micrometer. For example, when a distance between the electron emitter 102 and the anode 104 is about 1 millimeter, an output voltage of the power supply 1062 can be about 600 volts correspondingly.

When the electron emission device 100 is in operation, the second power supply circuit 108 is connected to terminals 1082*a* and 1082*b* of a power supply 1082 to supply a heating voltage/current for heating the electron emitter 102 to emit electrons therefrom steadily, whereby a steady emission current can be formed. The heating voltage is preferably in the range from about 15 to 100 volts, which can heat the electron emitter 102 up to a temperature ranging from about 1500 to 2000 kelvins (K) correspondingly. Generally, the heating voltage is related to the length of the carbon nanotube yarn (i.e. the electron emitter 102), the shorter of the length of the carbon nanotube yarn, the lower of the heating voltage required. Furthermore, the emission current can be readily adjusted by way of varying the magnitude of the heating voltage due to the relatively lower heating voltage.

Figure 3:
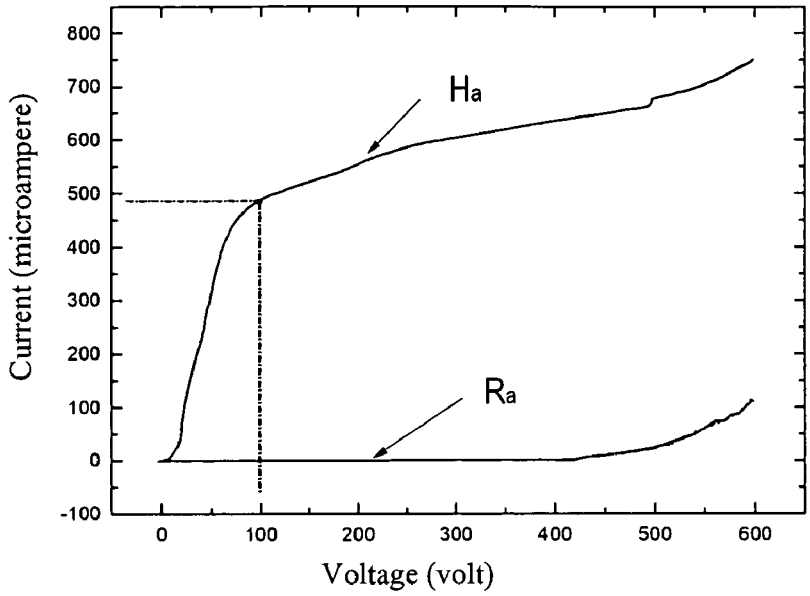
FIG. 3 shows a comparison of voltage-current curves respectively representing the carbon nanotube yarn of FIG. 1 operated at a room temperature condition (i.e. non-heated condition) and at a heated condition.

Referring to FIG. 3, a comparison of voltage-current curves respectively representing the electron emitter 102 operated at a room temperature condition (i.e. non-heated condition) denoted as Ra and at a heated condition denoted as Ha is shown. The horizontal axis represents voltage applied between the electron emitter 102 and anode 104, and the vertical axis represents emission current. A distance between the electron emitter 102 and the anode 104 is about 1 micrometer. It is noted that: when the electron emitter 102 is operated at the room temperature condition, an emission current is generated only when the voltage supplied by the power supply 1062 and applied between the electron emitter 102 and the anode 104 via the first power supply circuit 106 reaches up to about 600 volts. Contradistinctively, when the electron emitter 102 is operated at the heated condition, a practical emission current can be readily obtained. In this illustrated example, a heating voltage supplied by the power supply 1082 and applied on the electron emitter 102 via the second power supply circuit 108 is about 100 volts, and the electron emitter 102 is heated up to about 2000 kelvins correspondingly. For an illustrated purpose, as shown in FIG. 3, when a voltage applied between the electron emitter 102 and the anode 104 is about 100 volts, the emission current is about 500 microamperes (as denoted by the two cross dotted and dashed lines in FIG. 3); when the voltage applied between the electron emitter 102 and the anode 104 is about 600 volts, the emission current is about 750 microamperes.

Figure 4:
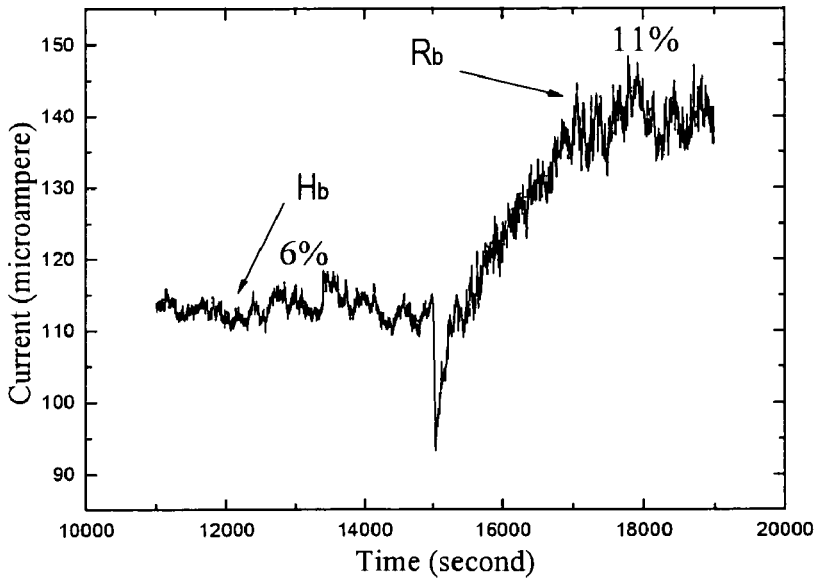
FIG. 4 shows a comparison of emission current stabilities of the carbon nanotube yarn of FIG. 1 respectively operated at a room temperature condition and at a heated condition.

Referring to FIG. 4, a comparison of emission current stabilities of the electron emitter 102 respectively operated at a room temperature condition denoted as Rb and at a heated condition denoted as Hb is shown. The horizontal axis represents time and the vertical axis represents emission current. In the interval of 10,000~15,000 seconds, the electron emitter 102 is operated at the heated condition. In the interval of 15,000~20,000 seconds, the electron emitter 102 is operated at the room temperature condition. A distance between the electron emitter 102 and the anode 104 is about 1 micrometer. It is noted that: when the electron emitter 102 is operated at the room temperature condition, an average fluctuation (calculated from variations of the emission current in the interval of 12,000~15,000 seconds) of the emission current is about 11%. Contradistinctively, when the electron emitter 102 is operated at the heated condition, an average fluctuation (calculated from variations of the emission current in the interval of 17,000~19,000 seconds) of the emission current is about 6%. That is to say, when the electron emitter 102 is operated at the heated condition, it can achieve an emission current with relatively higher stability. In this illustrated example, the heating voltage supplied by the power supply 1082 and applied on the electron emitter 102 via the second power supply circuit 108 is about 20 volts, the voltage applied between the electron emitter 102 and the anode 104 is about 600 volts, and the emission current is about 115 microamperes. Further, the stability of the emission current is related to the heating voltage, a suitable larger heating voltage facilitates the generation of the emission current with a higher stability.

Embodiment Two

Figure 5:
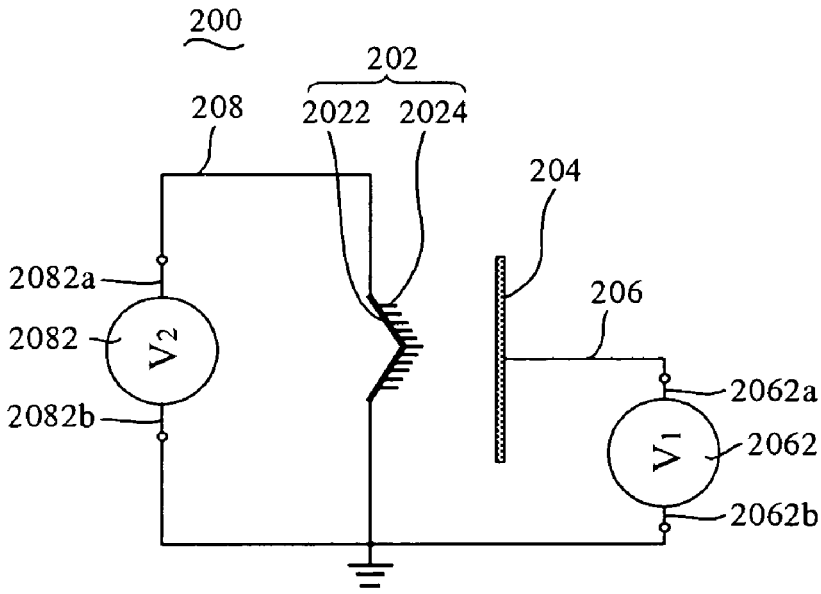
FIG. 5 is a schematic view of an electron emission device in accordance with a second embodiment.

Referring to FIG. 5, an electron emission device 200 in accordance with a second embodiment is shown. The electron emission device 200 includes an electron emitter 202, an anode 204 opposite to and spaced apart from the electron emitter 202, a first power supply circuit 206 electrically connected with the electron emitter 202 and the anode 204 and configured for generating an electric field therebetween, and a second power supply circuit 208 electrically connected with the electron emitter 202 and configured for supplying a heating current for heating the electron emitter whereby electrons emit therefrom.

The electron emitter 202 includes a refractory metal wire 2022 and a plurality of one-dimensional nanostructures 2024 formed on and electrically connected with the refractory metal wire 2022. When a heating voltage supplied by the power supply 2082 and applied on the refractory metal wire 2022 via the second power supply circuit 208, the one-dimensional nanostrucutures 2024 are heated to thereby emit electrons therefrom. The one-dimensional nanostructures can be formed on the refractory metal wire 2022 by way of a coating process. The refractory metal wire 2022 usually has a diameter of no less than 1 micrometer, and preferably has a melting point of no less than 1,600 degrees Celsius (° C.). The refractory metal wire 2022 can be a titanium wire (melting point of 1,668° C.), a molybdenum wire (melting point of 2,600° C.), a tantalum wire (melting point of 2,996° C.) or a tungsten wire (melting point of 3,380° C.). The one-dimensional nanostructures 1024 can be tubular, bacilliform, needle-like shaped, cone-shaped, or a mixture thereof. The one-dimensional nanostructures can be composed of carbon nanotubes or refractory metal materials, such as tungsten, molybdenum, titanium, tantalum or an oxide thereof. In the illustrated example, the one-dimensional nanostructures 1024 are composed of tubular carbon nanotubes.

The anode 204, the first power supply circuit 206 and the second power supply circuit 208 are respectively similar to the anode 104, the first power supply circuit 106 and the second power supply circuit 108 as above described in the first embodiment of the present invention. In the second embodiment, the first power supply circuit 206 electrically connects the anode 104 with the refractory metal wire 2022 of the electron emitter 202. The second power supply 208 is electrically connected with the refractory metal wire 2022 of the electron emitter 202. When the electron emission device 200 is in operation, the first power supply circuit 206 is electrically connected to terminals 2062*a* and 2062*b* of a power supply 2062, and the second power supply circuit 208 is electrically connected to terminals 2082*a* and 2082*b* of a power supply 2082.

Embodiment Three

Figure 6:
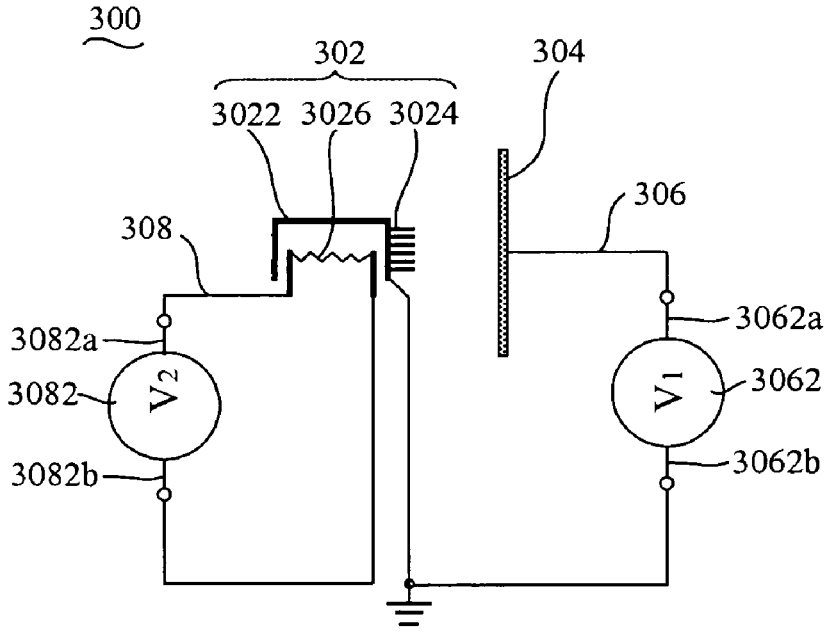
FIG. 6 is a schematic view of an electron emission device in accordance with a third embodiment.

Referring to FIG. 6, an electron emission device 300 in accordance with the third embodiment of the present invention is shown. The electron emission device 300 includes an electron emitter 302, an anode 304, a first power supply circuit 306 electrically connected with the electron emitter 302 and the anode 304 and configured for generating an electric field therebetween, and a second power supply circuit 308 electrically connected with the electron emitter 302 and configured for supply a heating current for heating the electron emitter 302 whereby electrons emit therefrom.

The electron emitter 302 includes a sleeve 3022 defining an opening (not labeled) therein, one-dimensional nanostructures 3024 formed on an outside surface of the sleeve 3022 and electrically connected therewith, and a filament 3026 placed in the opening and configured for indirectly heating the one-dimensional nanostructures 3024 to emit electrons therefrom. The sleeve can be made of a thermally conductive refractory metal, such as titanium, molybdenum, tantalum, tungsten or an oxide thereof. The one-dimensional nanostructure 3024 is similar to the one-dimensional nanostructure 2024 as described above. The filament 3026 can be a refractory metal filament, such as a tungsten filament, a titanium filament or a molybdenum filament.

The anode 304, the first power supply circuit 306 and the second power supply circuit 308 are respectively similar to the anode 104, the first power supply circuit 106 and the second power supply circuit 108 as above described in the first embodiment of the present invention. In the third embodiment, the first power supply circuit 306 electrically connects the anode 304 with the sleeve 3022 of the electron emitter 302. The second power supply circuit 308 is electrically connected with two terminals of the filament 3026. When the electron emission device 300 is in operation, the first power supply circuit 306 is electrically connected to terminals 3062*a* and 3062*b* of a power supply 3062, and the second power supply circuit 308 is electrically connected to terminals 3082*a* and 3082*b* of a power supply 3082.

In summary, in various embodiments of the electron emission device, the second power supply circuit thereof is used to supply a heating voltage/current to heat the electron emitter to emit electrons therefrom, whereby an emission current can be achieved. Because the heating voltage is relatively lower, preferably ranging from about 15~100 volts, and the emission current is related to the heating voltage, accordingly the emission current can be readily adjusted by way of varying the magnitude of the heating voltage. Furthermore, molecules accumulated at the electron emitter can be substantially removed via the heating voltage/current; consequently, the electron emission device can achieve an emission current with a relatively higher stability, even though the electron emitter thereof operated at relatively low vacuum.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An electron emission device, comprising:

an electron emitter comprising a plurality of one-dimensional nanostructures;

an anode opposite to and spaced apart from the electron emitter;

a first power supply circuit configured for electrically connecting the electron emitter and the anode with a power supply to generate an electric field between the electron emitter and the anode; and a second power supply circuit configured for electrically connecting the electron emitter with a power supply to supply a heating current for heating the electron emitter whereby electrons emit therefrom;

wherein the electron emitter further comprises a sleeve defining an opening therein and a filament placed in the opening, and the one-dimensional nanostructures are formed on an outside surface of the sleeve and electrically connected therewith, the first power supply circuit is electrically connected with the anode and the sleeve, and the second power supply circuit is electrically connected with two terminals of the filament.

2. The electron emission device of claim 1, wherein the electron emitter is a carbon nanotube yarn including a plurality of carbon nanotubes parallel to one another and bundled together by van der Waals interactions.

3. The electron emission device of claim 2, wherein the carbon nanotube yarn is bended.

4. The electron emission device of claim 2, wherein the carbon nanotubes yarn has a diameter of no less than 1 micrometer.

5. The electron emission device of claim 1, wherein the electron emitter further comprises a refractory metal wire; and wherein the one-dimensional nanostructures are formed on and electrically connected with the refractory metal wire.

6. The electron emission device of claim 5, wherein the refractory metal wire is made of a metal having a melting point of no less than 1600 degrees Celsius.

7. The electron emission device of claim 6, wherein the refractory metal wire is made of a metal selected from the group consisting of titanium, molybdenum, tantalum and tungsten.

8. The electron emission device of claim 1, wherein the one-dimensional nanostructures have a configuration selected from the group consisting of tubular configuration, bacilliform configuration, needle-like shaped configuration, cone-shaped configuration and a mixture thereof.

9. The electron emission device of claim 8, wherein the one-dimensional nanostructures are made of a material selected from the group consisting of carbon nanotube, tungsten, tungsten oxide, molybdenum, molybdenum oxide, titanium, titanium oxide, tantalum, and tantalum oxide.

10. The electron emission device of the claim 1, wherein the sleeve is made of a material selected from the group consisting of titanium, molybdenum, tantalum, tungsten and oxides thereof.

11. The electron emission device of the claim 1, wherein the filament is selected from the group consisting of a tungsten filament, a titanium filament and a molybdenum filament.

12. A method for generating an emission current, comprising the following steps of:

providing an electron emitter, the electron emitter comprising a plurality of one-dimensional nanostructures;

disposing an anode opposite to and spaced apart from the electron emitter;

applying a first voltage between the electron emitter and the anode configured for generating an electric field therebetween; and applying a second voltage on the electron emitter configured for generating a current to heat the electron emitter to emit electrons therefrom, thereby forming the emission current;

wherein the electron emitter further comprises a sleeve defining an opening therein and a filament placed in the opening, and the one-dimensional nanostructures are formed on an outside surface of the sleeve and electrically connected therewith, the first voltage is applied between the anode and the sleeve and the second voltage is applied on two terminals of the filament.

13. The method of claim 12, wherein the electric field generated between the electron emitter and the anode is about 0.6 volts per micrometer.

14. The method of claim 12, wherein the second voltage is in the range from 15 to 100 volts.

15. The method of claim 12, wherein the electron emitter is a carbon nanotube yarn including a plurality of carbon nanotubes parallel to one another and bundled together by van der Waals interactions.

16. The method of claim 12, wherein the electron emitter further comprises a refractory metal wire; and wherein the one-dimensional nanostructures are electrically connected with the refractory metal wire.

* * * * *

UNITED STATES PATENT AND TRADEMARK OFFICE

CERTIFICATE OF CORRECTION

PATENT NO. : 7,638,933 B2
APPLICATION NO. : 11/478406
DATED : December 29, 2009
INVENTOR(S) : Jiang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 612 days.

Signed and Sealed this

Ninth Day of November, 2010

David J. Kappos

David J. Kappos
*Director of the United States Patent and Trademark Office*